US008496480B2

(12) United States Patent
Guissin

(10) Patent No.: US 8,496,480 B2
(45) Date of Patent: Jul. 30, 2013

(54) VIDEO CAPTURE, RECORDING AND SCORING IN FIREARMS AND SURVEILLANCE

(76) Inventor: Avraham Ram Guissin, Moshav Beit Yannai (IL)

( * ) Notice: Subject to any disclaimer, the term of this patent is extended or adjusted under 35 U.S.C. 154(b) by 1471 days.

(21) Appl. No.: 11/571,271

(22) PCT Filed: Jun. 26, 2005

(86) PCT No.: PCT/IL2005/000680

§ 371 (c)(1),
(2), (4) Date: Feb. 20, 2008

(87) PCT Pub. No.: WO2006/001016

PCT Pub. Date: Jan. 5, 2006

(65) Prior Publication Data

US 2008/0233543 A1 Sep. 25, 2008

Related U.S. Application Data

(60) Provisional application No. 60/583,157, filed on Jun. 26, 2004.

(51) Int. Cl.
*F41G 3/26* (2006.01)

(52) U.S. Cl.
USPC ..... 434/19; 434/11

(58) Field of Classification Search
USPC .. 434/11–27; 42/111, 123, 130, 132; 235/404
See application file for complete search history.

(56) References Cited

U.S. PATENT DOCUMENTS

| | | | | |
|---|---|---|---|---|
| 3,785,261 | A | 1/1974 | Ganteaume | |
| 3,911,451 | A | 10/1975 | Vockenhuber | |
| 4,290,219 | A | 9/1981 | Boller et al. | |
| 4,309,095 | A | 1/1982 | Buckley | |
| 4,352,665 | A | 10/1982 | Kimble et al. | |
| 4,830,617 | A | 5/1989 | Hancox et al. | |
| 4,835,621 | A | 5/1989 | Black | |
| 4,955,812 | A * | 9/1990 | Hill | 434/16 |
| 5,020,262 | A | 6/1991 | Pena | |
| 5,842,300 | A | 12/1998 | Cheshelski et al. | |
| 5,887,375 | A | 3/1999 | Watson | |
| 6,192,614 | B1 | 2/2001 | Cliburn | |
| 6,305,941 | B1 | 10/2001 | Kotsiopoulos et al. | |
| 6,449,419 | B1 | 9/2002 | Brough et al. | |
| 6,530,782 | B2 | 3/2003 | Fouse et al. | |
| 2002/0197584 | A1 * | 12/2002 | Kendir et al. | 434/21 |

* cited by examiner

*Primary Examiner* — Timothy A Musselman
(74) *Attorney, Agent, or Firm* — Oliff & Berridge, PLC

(57) ABSTRACT

A video camera and recording device integrated with a real or toy weapon to provide video recording of the assault and aiming process of the weapon holder in operational training, actual combat, hunting, sports and gaming scenarios. A video camera is boresighted with the weapon, and a video memory stores the recorded dynamic scenario, and a trigger sensor which continually senses and records the triggering actions imposed by the weapon holder. The trigger sensor is attached to the actual trigger of the weapon thus enabling normal operation of the weapon. The video camera, may be mounted internally within the bore of the weapon, such that the external form of the weapon is not altered, thus achieving closer operation to real life situations. The recorded trigger data is utilized upon playback of the recorded video, enabling quick review and scoring of the recorded aiming process for training and gaming.

22 Claims, 8 Drawing Sheets

Regular bullet

Training bullet

Standard BFA for the M-16 rifle- PRIOR ART

IBFA Configuration

Video Digitizing Flashlight Application

VIDEO CAPTURE, RECORDING AND SCORING IN FIREARMS AND SURVEILLANCE

CROSS-REFERENCE TO RELATED APPLICATIONS

This application is a U.S. National Phase Application under 35 U.S.C. 371 of PCT International Application No. PCT/IL2005/000680, which has an international filing date of Jun. 26, 2005, and which claims priority from U.S. Provisional Patent Application No. 60/583,157, filed Jun. 26, 2004, both of which are incorporated herein by reference in their entirety.

FIELD OF THE INVENTION

This invention generally relates to firearms training and gaming, and more particularly, to a video capture, recording and scoring device which is attached to and integrated with an actual weapon for use in training exercises, simulations or the like.

BACKGROUND OF THE INVENTION

Exercises and simulations are extremely useful for training individuals in the use of firearms, including for example military personnel, law enforcement officers, and firearm permit owners who may seldom have an opportunity to use their weapons. One particularly useful type of training exercise or simulation involves confronting an individual having a firearm with a series of targets and threats. In such a simulation, the object is for the trainee to aim and fire the weapon at the targets or threats as quickly and accurately as possible while maneuvering in the natural and realistic environment of the operative or sporting encounter, and also without firing at possibly friendly targets.

The ability to record and review the motion, assault and aiming actions of the trainee in a simulated firing training while using the actual weapon reduces the expense and improves safety compared to live ammunition training. This is true for dry training, where no actual firing takes place, as well as in blank firing.

Another use of the invention is in gaming using toy guns and air guns.

A variation on this training exercise is to have multiple participants involved in the training and simulation exercise. In such case, all the participants' video recording devices are synchronized in time so as to enable post-exercise display and scoring of the exercise. For example, the multiple recordings may accurately depict which participant successfully fired and hit the another.

Previous art teaches various ways of mounting video cameras and recording means on guns for training and operational purposes. A number of such prior art documents are now briefly reviewed.

U.S. Pat. No. 3,785,261, to Ganteaume, teaches an apparatus adapted to make an immediate photographic record of a theoretical hit such as in hunting wild game. There is disclosed both a mechanical and an electrically actuated means for causing this theoretical hit to be exposed on the film of a camera which is carried by and actuated with the pulling of the trigger of the gun. The distance, trajectory and wind factors are reflected in this photographic record. The hunter using the gun fires a blank cartridge rather than a real cartridge so that this photographic record indicates what results this hunter would have achieved had a real bullet been fired.

U.S. Pat. No. 3,911,451, to Vockenhuber, relates to a telescopic gun sight with a mount for a removable camera to enable an object to be photographed through the telescope. The light path from the telescope to the camera is provided by a beam splitter which separates some of the light traveling along the optical axis of the telescope and diverts it towards a collimator and a window in the wall of the telescope. The collimator provides parallel rays from this diverted light so that the camera attached to the mount can be a fixed focal-length camera. An arrangement is provided for blanking off the window when the camera is not fitted to the telescope.

U.S. Pat. No. 4,920,219, to Boller, et al., disclosed a rifle having a telescopic sight for recording the target as seen through the telescopic sight at the instant the trigger is pulled. The apparatus includes a beam splitter for directing to a camera some of the light passing through the telescopic sight. The shutter mechanism of the camera is coupled to the rifle trigger so that the camera will "shoot" the picture of the target when the trigger is pulled. The camera is of the instant-copy type so that pictures of the target can be viewed shortly after "shooting". The apparatus thus enables the ability of a rifleman to be tested without the need for firing live ammunition.

U.S. Pat. No. 4,309,095, to Buckley, teaches a camera mounting device for mounting a camera to a hunting rifle. The device comprising a first mounting bracket adapted to support a camera, a threaded fastener to detachably secure a camera to the first bracket, a variable diameter clamp to clamp the first mounting bracket to the barrel of the telescope sight of a rifle, a cable release for remote actuation of the camera, a second mounting bracket connected to the cable release, and threaded fasteners for detachably securing the second mounting bracket to the trigger guard of a rifle so that actuation of the cable release is coordinated to actuation of the rifle trigger.

U.S. Pat. No. 4,835,621, to Black, relates to a video camera recording device having a gunstock and a support structure which includes a mounting platform adapted to receive thereon a hand held video camera recorder having a lens structure defining a line of sight, a recording medium for recording video information, and a viewfinder and mounting structure for mounting the viewfinder onto the gunstock. Structure is provided for effecting a sequential activating and deactivating of the video camera recording device for the purpose of starting a recording of video information onto the recording medium and stopping the recording, respectively. A gun sight is located in the line of sight so as to be visible through the viewfinder when the video camera recorder is recording video information on the recording medium. A trigger is provided on the gunstock and is adapted to be manually activated by a finger of a user's hand. A signal generator is provided which generates a signal visible through the viewfinder in response to the user activating the trigger. The signal is also simultaneously recorded on the recording medium.

U.S. Pat. No. 5,020,262, to Pena, discloses a camera mount for use on a telescope in combination with a rifle. The mount is clamped onto the telescope, and has a camera attached to the top of the mount. A cable mechanism is attached at one end to the shutter release of the camera and at the other end to the trigger of the rifle. The camera is arranged to photograph the image received through the telescope and reflected through the mount. The cable mechanism provides means for controlling the operation of the camera. A housing is clamped onto the telescope and has an eyepiece which fits onto the eyepiece of the telescope and contains a split prism which is positioned in the eyepiece at an angle such that it can be seen through for viewing the image of the target received through the telescope. The split prism has a reflective surface on one side which reflects the image of the target upwardly to a first surface mirror positioned in the housing above the split prism at an angle such that it receives the image reflected from the split prism, and then reflects the image forwardly to a second surface mirror. A second surface mirror is positioned at the forward end of the housing and at an angle that it receives the image reflected from the first surface mirror, and then reflects the image upwardly to the camera lens. The image of the target is photographed when the trigger of the rifle is pulled.

U.S. Pat. No. 5,887,375, to Watson, teaches a camera mount for firearms. The mount comprises a base plate; an intermediate plate operatively attached to the base plate; a dampening material, operatively attached between the base plate and the intermediate plate, for dampening recoil forces transmitted to the intermediate plate; and a mounting plate removably attached to the intermediate plate. The mounting plate includes a camera attachment device for allowing attachment of a camera to the mounting plate; and an adjustment mechanism, operatively connected between the intermediate plate and the mounting plate, for allowing the camera to be aligned with respect to the firearm. The camera mount further includes a firearm mounting device, operatively attached to the base plate, for mounting the camera mount to the firearm.

U.S. Pat. No. 4,352,665, to Kimble, teaches a weapon training simulation system comprising a firearm with a variable data transmission system mounted therein. The system includes at least one sensor to detect detonation of a blank round in the firearm, a variable data transmitter enabled by said sensor to transmit a signal comprising a weapon identification and, optionally, a direct hit/near miss selection, a power amplifier to amplify said signal, and a laser to project said amplified signal along the boresight of said firearm. The laser is mounted in the barrel of the firearm, and the other electronic components may be advantageously mounted in the handgrip or stock thereof.

U.S. Pat. No. 4,830,617, to Hancox, teaches an apparatus for the simulated shooting of small arms comprises a miniaturized electrical energy source for a radiation emitter which is capable of being accommodated within a dummy cartridge or within the gun barrel. The source can be a capacitor slidably located within the dummy cartridge and which co-operates with a barrel unit housing a switch section, an electronics section, and a pulsed infra-red emitter. On firing the gun the capacitor is propelled forwards by the firing pin of the gun until a probe-like switch portion on the capacitor contacts a corresponding switch portion on the barrel unit so actuating the emitter to give a series of timed pulses which pass through a lens system.

U.S. Pat. No. 4,835,621, to Black, teaches A video camera recording device having a gunstock and a support structure for which includes a mounting platform adapted to receive thereon a hand held video camera recorder having a lens structure defining a line of sight, a recording medium for recording video information, and a viewfinder and mounting structure for mounting the viewfinder onto the gunstock. Structure is provided for effecting a sequential activating and deactivating of the video camera recording device for the purpose of starting a recording of video information onto the recording medium and stopping the recording, respectively. A gun sight is located in the line of sight so as to be visible through the viewfinder when the video camera recorder is recording video information on the recording medium. A trigger is provided on the gunstock and is adapted to be manually activated by a finger of a user's hand. A signal generator is provided which generates a signal visible through the viewfinder in response to the user activating the trigger. The signal is also simultaneously recorded on the recording medium.

U.S. Pat. No. 5,842,300, to Cheshelski, teaches a retrofittable laser system utilizing miniaturized components which are insertable into a pistol barrel which emits a laser module light pulse when a pistol firing trigger activates a pistol firing pin. The pistol further comprises a pistol housing and a pistol ammunition chamber.

U.S. Pat. No. 6,192,614, to Cliburn, teaches a video camera mounting system for a firearm, such as a rifle or a shotgun, to simultaneously video a target at the time of the "kill". The system includes a video mounting assembly that incorporates a shock absorbing mechanism to protect the video camera against the recoil of the firearm, and a pivotally mounted platform to finely adjust the video camera toward the target.

U.S. Pat. No. 6,305,941, to Kotsiopoulos, teaches a training weapon for use in firearm training simulations involving multiple participants each of whom is armed with a training weapon. The training weapon includes a trigger which is coupled with a switch that is part of an electrical circuit including a power supply and an indicator light. The trigger and switch being arranged such that when the trigger is depressed the switch closes the circuit thereby turning on the indicator light.

Much of the above mentioned prior art describes applications in which external additions are attached to the weapon, thereby changing the characteristics of the use of the weapon. In true combat simulation and training, it may be important to maintain the exact external form of the weapon on which the training is performed. Furthermore, the addition of external accessories may mandate adaptations to the structure of the weapon itself, which may not be simple or advisable.

The disclosures of each of the publications mentioned in this section and in other sections of the specification, are hereby incorporated by reference, each in its entirety.

OBJECTS AND SUMMARY OF THE INVENTION

An object of the present invention is to provide a simply installed, low cost, training capability to an actual weapon, whereby the trainee uses the actual weapon in the training process as he would in a real situation of maneuvering, aiming, "dry" shooting and blank shooting. A training kit for this purpose utilizes a video camera and a trigger sensing unit integrated onto the weapon in such a manner that the outer shape and form factor of the weapon remain unaltered; thereby enabling regular weapon operation in training. The video camera is boresighted with the weapon to indicate the aimpoint of the weapon, and the trigger sensing unit indicates the exact instant of firing by the trainee Additionally, a video memory can be optionally integrated on the weapon, or remotely located with data transmitted thereto from the kit on the weapon, and a light source for illuminating the target area. The recorded video and trigger time recordings are utilized for post exercise, computerized, aiming and pointing accuracy assessments using digital image processing techniques.

The system is used for training personnel in the use of actual firearms, and provides accurate feedback with respect to the accuracy of the target acquisition and aiming process, the timing of the shot taken and the progression of firings in single and multiple participant training. In addition, in post-exercise scoring, the recorded video data is analyzed by video processing algorithms, which may automatically track the target chart or the intended aim point on the threat depicted in the video, in assessing the aiming and shooting.

The training kit preferably utilizes an insert containing the video camera, which is inserted into the barrel of the weapon such that it is boresighted with the weapon, and does not present any attachments or appurtenances which change the external features or form of the weapon. This feature is important in enabling the trainee to have the feel of the weapon in exactly the same manner as he would in true combat. Likewise, the trigger sensing unit is also preferably constructed and mounted on the weapon conformally with the actual trigger.

The insert may be inserted into the front part of the barrel, in which case a good field of view is available, or it may be loaded from the breech. The latter case has the advantage that the insert may then be provided having the same external form as a round of ammunition, and can be loaded conventionally, but the field of view is more limited. Such a bullet can also preferably incorporate an electronic module for processing and storing or transmitting the video data.

According to a further preferred embodiment of the present invention, an imaging blank firing attachment is provided, incorporating a video camera, and optional electronic processing circuitry, such that the training kit can be used for providing real time video images of the weapon being fired using blank rounds, or alternatively in dry training. This embodiment is particularly useful for imaging training with automatic weapons, where the use of blank cartridges provides realistic recoil characteristics to the use of the weapon.

A variant of the system may also be utilized on an operational weapon, whereby the video recording may be used for training as well as post-operational assessments. In such cases the video may also be utilized in force command and control applications, or in surveillance applications.

Another object of the present invention is to provide a training system and weapon as characterized above which is relatively inexpensive to produce, install and operate.

Additionally, a further preferred embodiment of the system may be used to provide a surveillance flashlamp, which enables a scene being viewed to be transmitted to a remote location for recording or surveillance support. Such an imaging illuminating device is particularly useful for law-enforcement officers.

There is therefore provided, in accordance with a preferred embodiment of the present invention, a system for training use of a small-arms weapon having a barrel, the system comprising (i) an insert comprising a video camera, the insert having dimensions enabling it to be inserted into the barrel of the weapon, and (ii) an electronic processing unit receiving an output of the video camera, wherein the insert is such that the training use of the weapon is not affected by use of the system.

In the above described system, the electronic processing unit can preferably also be located within the insert, or it can be located remotely from the insert. The system may also preferably comprise a battery.

In accordance with yet another preferred embodiment of the present invention, in the above described systems, the electronic processing unit may preferably comprise a memory for storing data originating from the video camera, or it may transmit data originating from the video camera to a remote location.

In any of the above described systems, the external form of the weapon is preferably unaffected by use of the system. Furthermore, the use of the weapon is preferably unaffected by use of the system. Additionally, use of the system does not mandate any alteration to the weapon.

In accordance with still another preferred embodiment of the present invention, in any of the above systems, the insert preferably has essentially the same external outline as a bullet for use in the weapon. Additionally and preferably, the video camera is boresighted with the weapon. The insert may preferably be inserted into the breech of the weapon, or into the front of the barrel. If breech inserted, then the insert may preferably also comprise, if for use in a revolver, a rear view imager for detecting rotation of a revolver barrel.

There is further provided in accordance with still another preferred embodiment of the present invention a system as described in any of the above embodiments, and wherein the weapon also comprises a trigger, the system also preferably comprising a trigger sensing unit which provides a signal when the trigger of the weapon is pressed. In such a system, the trigger sensing unit is such that it does not affect the user's tactile sensation of the trigger.

In accordance with a further preferred embodiment of the present invention, there is also provided a training round of ammunition for a weapon, the round comprising a video camera for generating a forward looking boresighted image when the round is inserted into the breech of the weapon, and wherein the round has an external form essentially identical to that of a conventional round for the weapon. The round also preferably comprises at least one of an electronic processing unit receiving an output of the video camera, a battery, and a hammer hit detector. In place of the hammer hit detector, and for use in a revolver, the round also preferably comprises a rear view imager for detecting rotation of the revolver barrel.

There is provided in accordance with yet a further preferred embodiment of the present invention a system for training use of a weapon having a barrel, the system comprising a blank firing attachment for attachment to the front end of the barrel of the weapon, the blank firing attachment comprising (i) a plug for keeping sufficient gases in the bore to ensure automatic operation of the weapon, and (ii) a video camera boresighted with the weapon. In such a system, the blank firing attachment also preferably comprises a light source for illuminating at least the field of view of the camera. Additionally and preferably, the blank firing attachment may also comprises at least one of an electronic processing unit receiving an output of the video camera, a battery and a weapon recoil sensor.

There is even further provided in accordance with a preferred embodiment of the present invention, a blank firing attachment for a weapon, the blank firing attachment being attached to the front end of the bore of the weapon, and comprising (i) a plug for keeping sufficient gases in the bore to ensure automatic operation of the weapon, and (ii) a video camera boresighted with the weapon. The blank firing attachment also preferably comprises a light source for illuminating at least the field of view of the camera. Additionally and preferably, the blank firing attachment may also comprises at least one of an electronic processing unit receiving an output of the video camera, a battery and a weapon recoil sensor.

Furthermore, in accordance with yet another preferred embodiment of the present invention, there is provided a trigger sensing unit for use on a training weapon, comprising (i) an attachment element for attaching the trigger sensing unit to the weapon, and (ii) a sensor for detecting when the trigger is pressed, wherein the trigger sensing unit is disposed such that a user's tactile sensation of the trigger is unaffected by use of the trigger sensing unit. The attachment element preferably comprises a pair of side elements which attach to each other, thereby clamping the unit to at least one of the finger guard of the weapon, and the body of the weapon proximate the trigger. In this trigger sensing unit, the sensor is preferably disposed laterally behind the trigger, such that pressure on the trigger actuates the sensor unit, or it is disposed laterally forward of the trigger, such that intended pressure on the trigger first actuates pressure on the sensor. In any of the above embodiments, the trigger sensing unit provides a signal when the trigger of the weapon is pressed. The sensor may preferably be a strain gauge element or a motion detection element.

In all of the above trigger sensing unit embodiments, the trigger sensing unit may be attached to the weapon without mandating any alteration to the weapon, nor is the use of the weapon is affected by use of the trigger sensing unit.

There is also provided in accordance with a further preferred embodiment of the present invention, an imaging illuminator device, comprising (i) an illumination source, (ii) a video camera generally aligned with the direction of illumination of the illumination source, and (iii) a transmitter for sending images from the video camera to a remote location. The remote location may preferably be a surveillance position for remote monitoring of a scene illuminated by the device. The imaging illuminator device may preferably also include a memory unit for storing data from the video camera. The illumination may preferably be in the visible spectral range or the infra red spectral range.

In accordance with yet another preferred embodiment of the present invention, there is also provided a system for assessing the accuracy of a user's aimpoint at a target, the system comprising (i) a weapon having a trigger and a boresighted video camera system, (ii) an image processing unit receiving an output of the video camera, and displaying an image depicting the aimpoint of the weapon, (iii) a trigger sensor unit attached to the weapon, for detecting when the trigger is pressed, (iv) a computer system for displaying the image depicting the aimpoint of the weapon, (v) a designating system for designating an intended target aimpoint on a video frame depicting the target, and (vi) an image matching algorithm for transforming the intended target aimpoint to at least one frame depicting the target at a later time. The at least one frame depicting the target at a later time may preferably be a frame taken when the trigger is pressed or it may be a series of frames taken up to the point when the trigger is pressed.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF PREFERRED EMBODIMENTS

A first preferred embodiment of the invention is an add-on kit to small arms or firearms including handguns and rifles, which when installed on the actual weapon, converts it into a training weapon for scoring of aiming. The terms small arms or firearms are understood to be used and claimed in this application for any weapon which is generally hand-carried by the user, such as pistols, revolvers, assault rifles, shotguns, and the like.

Figure 1:
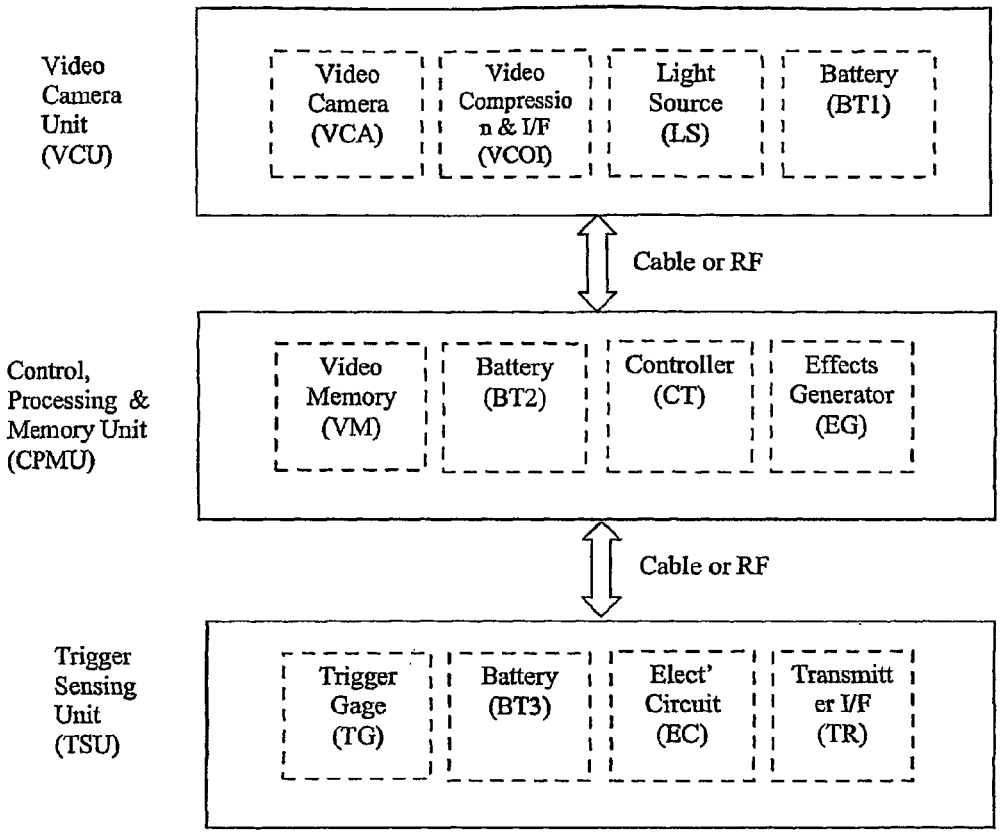
FIG. 1 is a block diagram of the main units of the training system, and their respective interconnections.

FIG. 1 depicts a block diagram of the functional components of the add-on training kit comprising three units, namely a) a miniaturized video camera unit (VCU), b) a controller, video processing and memory unit (CPMU), and c) a trigger sensing unit (TSU).

The kit is designed to provide full "dry" and blank firing training and scoring capability, while maintaining in full the outer shape and form factor of the weapon. This feature is important so as to enable, for example, the regular use of the handgun holster in the training exercise. The alternative of connecting any part of the kit in a way that would change the outer shape or form factor of the weapon may alter its training use compared to its operational use. In the case of an assault rifle training, the trainee may use his own rifle equipped with the kit which does not alter the form factor of the weapon or the way it is used in action.

The VCU is preferably battery operated, and is preferably designed to integrate onto the weapon in various possible configurations, including (a) fitting into the front barrel and the flash reducer, (b) fitting into the blank firing attachment which is used when training with blank rounds or may be used in dry training, (c) fitting as an external attachment, (d) fitting into the back barrel as a training bullet, thus enabling regular operation of the weapon in various training modes. The above fitting options may each provide different advantages. For example, by fitting the camera in the barrel or via the blank firing attachment, (i) the a-priori mechanical boresighting of the system, prior to the required boresighting of the camera with the weapon sight is improved, and (ii) the form factor of the weapon is maintained in training.

The placement of the VCU in the front end of the weapon barrel enables a wide optical field of view (FOV) so as enable the scoring of the process in which the trainee performs line of sight slewing and target acquisition prior to opening fire.

The VCU may transmit the video signal thru an RF link or a cable connection. Bandwidth and storage constraints may require video compression. MJPEG or MPEG compression are suitable solutions. The VCU may be configured to generate video continuously throughout a training session, but transmission or recording may take place only upon trigger activation using a small FIFO video memory.

In order to support day as well as night training, the VCU may provide low light level imaging capability via a sensitive imaging chip and image processing, and/or Light Source (LS) illumination capability of the observed FOV. The LS may be designed to share the Video Camera (VCA) optic via a beam splitter or via a separate optic which is boresighted with the VCA line of sight. The LS may, for example, utilize a Light Emitting Diode (LED) which is activated only when the trainee presses the trigger and generates a signal from the TSU. Therefore, the VCU FOV is illuminated only when a simulated shooting is to occur, and this saves battery power. Moreover, in the case where the trainees or instructors utilize night vision goggles for observing the scene, the LS flash will also represent the gun flash effect, and will not uncover the trainee prior to the shooting. The LS flash may be relatively short. For example, if the scoring system requires several captured video frames with sufficient contrast of the intended target (e.g. ~5 frames), then this requires scene illumination of ~⅙ second for a 30 Hz camera. The LS flash should be operable only in dark or low light conditions. In day time, the VCA should have sufficient sensitivity for imaging. In the dark, the LS flash may be observable by the naked eye as would be expected at night time while shooting. Therefore, the visible spectral band may be acceptable for the system. However, an additional preferred embodiment may provide an LS source in the Near IR (NIR) band which will provide a "red" flash effect for the naked eye, and whereby the camera is sensitive enough in that spectral band so as to enable sufficient imaging contrast.

For situations where the training is with respect to aiming the weapon against target boards, the VCA and LS can be used effectively for supporting automated scoring. For example, if a target board includes a strip of retro reflective tape, for example in a cross configuration, then that cross will be clearly observed in the image, and that could be used in offline scoring to assess aiming stability and accuracy. Retro reflective tape or other reflective means may be attached to man targets, such as in the case of one on one or one on many or many on many training modes described herein.

An additional preferred embodiment, may include a man target or a fixed or moving target board equipped with a respective LED source, such that the VCA easily detects the Target Source (TS). As the TS appears in the VCA image, scoring of the aiming can be more easily achieved. LED or other illumination sources may be attached to man targets, such as in the case of one on one or one on many or many on many training modes described herein. Such means may be time encoded (modulated) so as to enable easier detection and possible identification via decoding of the light modulation.

Typically, the VCA will have a FOV large enough to observe the slewing and dynamic aiming prior to opening fire, and high enough resolution for assessing the accuracy of the aiming at the time of firing. Assume a camera of 320×240 pixels with a FOV of 10×7.5 degrees. This results in a pixel resolution of 0.5 mrad. Such pixel resolution results in a pixel size of 5 cm at 100 meters, and 2.5 cm at 50 meters, etc. For a 10 micron pixel pitch in the camera, this will require a 20 mm focal length, and with an aperture of 10 mm, this results in F#=2 which will provide good sensitivity. A smaller camera pitch will result in a proportionately smaller aperture. For a 5 micron pitch, a 10 mm focal length results, and a 5 mm lens aperture results for a F#=2. VCA configurations requiring the fitting into the front or back bore of the weapon; may require <2 mm aperture optics in order, for example, to fit into a 5.56 mm caliber weapon. Such smaller aperture optic with 10 mm focal length, results in a higher F#=5, and resulting in the need for an improved imaging chip.

In some configurations, the CPMU may be integrated together with the VCA. Another preferred alternative in the case of weapons using cartridges, is the placement of the CPMU integrated in a specialized magazine of standard dimensions for the particular weapon. For revolvers and shotguns, for example, the VCA and CPMU are preferably integrated together into a single unit which may be placed in the front bore. In the case of the shotgun, the unit may also be placed in a training round which is conventionally inserted into the shotgun. An alternative to this may also be that the CPMU is carried by the trainee himself, for example in a spare magazine in a respective holster. The CPMU includes a digital video memory unit large enough to store sufficient video imagery, depending on the compression ratio. The CPMU, when installed in a magazine and inserted into the weapon in the same way as a standard magazine, may also preferably generate firing effects such as sound and mechanical recoil.

In those embodiments where the CPMU is carried by the trainee, for example as a spare respective magazine in a pouch or pocket. In such embodiment, the CPMU control and effects functions are implemented in the cartridge which is placed in the weapon, while the digital video memory may be carried by the trainee in a separate pouch.

According to the above noted camera pixel format, the CPMU will typically receive 320×240 pixels×30 frames per second=2 Mbyte/sec=16 Mbit/sec. A MJPEG compression of 10:1 will yield 1.6 Mbit/sec data rate. Such data rates can be supported by various digital transmission data links such as for example blue tooth. Moreover, a variable compression rate may provide better quality; for example the center of the FOV may be less compressed for assessing the aiming accuracy, while the remaining FOV is compressed at a proportionately higher ratio because the peripheral FOV is less important for scoring the aiming process.

The TSU is preferably clamped to the trigger finger guard, so as to provide pressure sensing, which can be measured by a strain gage, or by sensing the trigger movement, which can be sensed by a micro switch. Further details of the TSU structure are provided below in relation to FIG. 3.

In the case of revolvers, where the VCU is preferably placed in the front bore so as to maintain the weapon front form factor, the TSU may be replaced by a light sensor in the back side of the VCU sensing the rotational movement of the bullet drum, and/or a blank bullet equipped with a mechanical sensing device which senses the action of the hammer hitting the back end of the bullet.

Figure 2B:
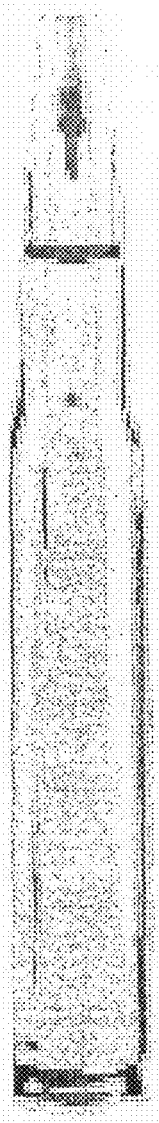
FIG. 2B shows a real bullet for comparing with the external shape of the training bullet option of FIG. 2A.
Figure 2A:
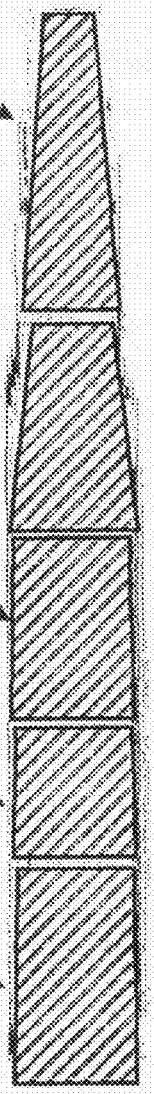
FIG. 2A is a view of a training bullet option whereby parts of a Video Camera Unit (VCA) and a Control, Processing and Memory Unit (CPMU) are incorporated within a bullet which is placed in the weapon bore as if to be fired.

Reference is now made to FIG. 2A which is a schematic illustration of another preferred embodiment of the invention is where the VCU, CPMU and TSU are all integrated into a training bullet 20. For an automatic weapon, the bullet is inserted into the back bore of the barrel as would a regular bullet be by the action of the bolt. Moreover, It may be more specifically applicable for those weapons which use a hammer mechanism and manual entry of bullets such as revolvers and shotguns. In the case of a shotgun, the training bullet may also incorporate a hammer hit sensing mechanism such that the TSU becomes redundant. As depicted in FIG. 2A, the Mng bullet has the VCU 22 in the front, and the CPMU 24 is located in the back side. In addition, a memory unit 26, a battery 27 and a hammer hit detector 28 may preferably be incorporated into the bullet. For handguns, the VCU when placed in the bullet provide FOV ~10-20 degrees—large enough for the training and scoring application. For longer barrel rifles and shotguns, the FOV is smaller ~1 degree. At 10 meters, such smaller FOV is equivalent to 17 cm. Such FOV may be sufficient for a typical aiming target board with an aiming cross, but not for analyzing the entire slewing process by which the trainee brought the aiming line of sight to the target. In FIG. 2B there is shown a schematic illustration of a real bullet, 29, drawn to the same scale as the training bullet of FIG. 2A.

For the case of the revolver, another preferred embodiment may be utilized, whereby the VCU in addition to its front imaging VCA, additionally incorporates a backward optical imaging sensor 21 which may image the revolving action of the revolver drum from within the bore. When the trainee pulls the trigger, the revolver drum begins to revolve. Image processing of the backward imaging sensor 21 detects the revolving action via image change detection algorithms, and provides the triggering input instead of the TSU. It is to be understood that such a backward imaging sensor 21 then replaces the hammer hit detector 28, if fitted.

A similar solution is that for a shotgun, whereby each barrel receives a training bullet, and all the system operation is done within the bullet itself, including the VCA 22, CPMU 24 and hammer hit detector 28.

Figure 3:
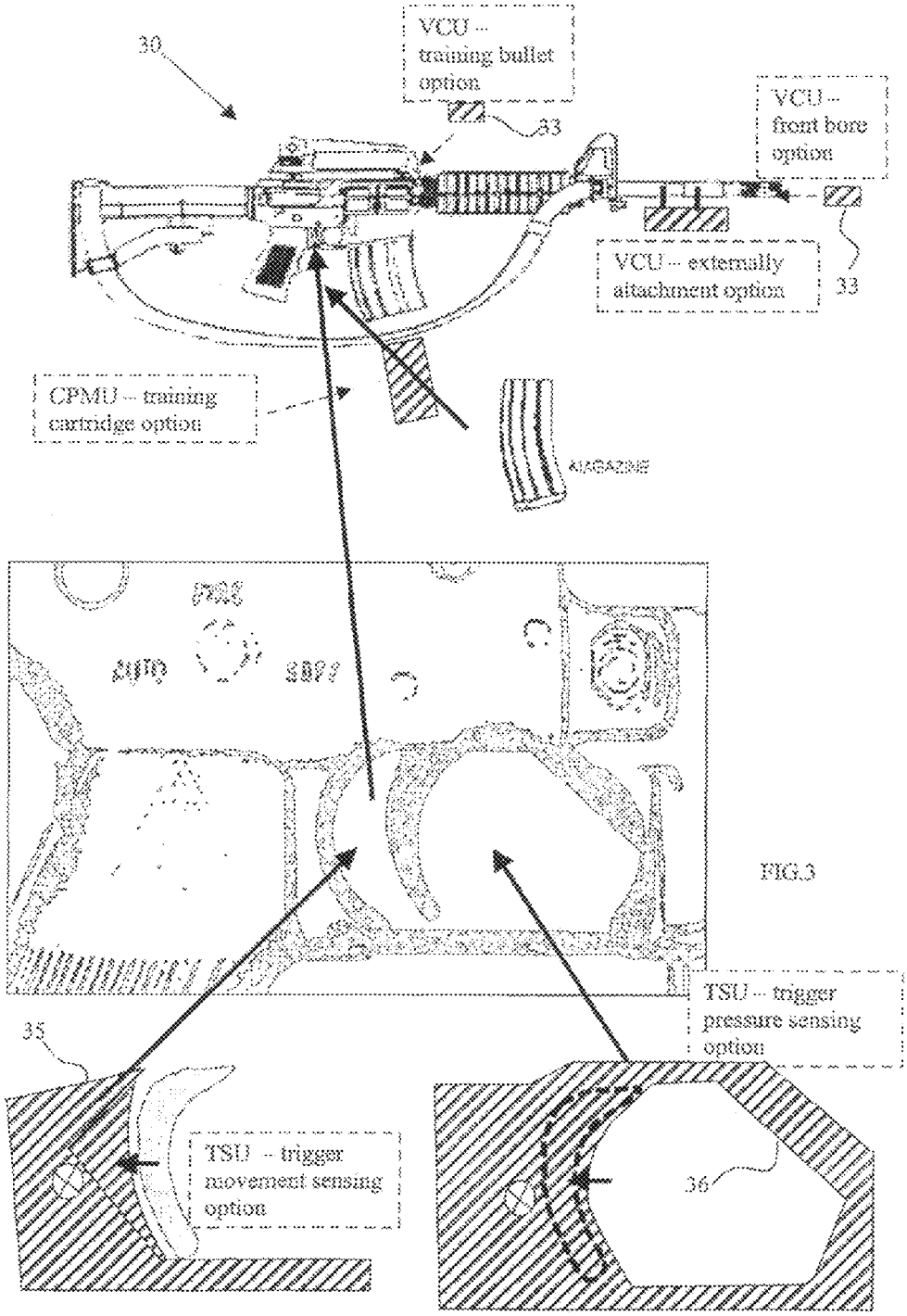
FIG. 3 is a side view of one embodiment of a representative rifle, illustrating the three main components of the training system integrated into the weapon by utilizing the teachings of the present invention.

Referring now more particularly to FIG. 3 there is shown an illustrative embodiment of a training kit, which when installed on an actual weapon such as an assault rifle, 30, turns the actual weapon into a training weapon for use in training exercises, simulations, aiming practice, gaming and sporting.

The VCU may be installed in the front bore of the weapon (within the muzzle flash reducer) 31 such that boresight is largely maintained, prior to final alignment before the exercise, or as an external attachment to the bore, 32, or as a training bullet 33, as shown in FIG. 2A above. Another preferred embodiment may have the VCA installed in the flash reducer and the bore, while the VCU battery BT1 and light source LS are installed externally along the bore. An additional option may be to install the CPMU along with the BT1 of the VCU, such that no video transmission is required. In such case the BT2 unit in the training cartridge is useful mainly for the controller and the effects generator of the CPMU. The effects of the CPMU are the firing sound generator, and a possible recoil generator. In such case the CPMU simply receives the trigger signal for generating the effects, and the VCU becomes the fully integrated VCA and video memory, and also receives the trigger signal.

The TSU may preferably be configured as depicted in the lower part of FIG. 3, preferably as a clamp-on device 35 which is clamped to the trigger finger guard, or clamped to the body of the weapon in the region of the trigger, or clamped to both, depending on the type of weapon, to form what is termed herein as the "TSU enclosure". Alternatively and preferably, the TSU can be clipped into place within the trigger guard, where such attachment is possible. The trigger movement sensing option is designed to sense the actual backward movement of trigger when pressed by the user, or the pressure on the trigger when pressed by the user, and this may be achieved using a microswitch or a strain gage behind the trigger. In such embodiments, the trigger remains outside the TSU enclosure, which is located laterally to the rear of the trigger, and the user presses the actual trigger backwards.

According to a further preferred embodiment, as shown in the lower part of FIG. 2, the TSU 36 is attached on either side of the trigger, and includes an activation element which is located either laterally in line with the trigger, or very slightly in front of it, such that the user's finger presses on this element to activate the trigger sensor, rather than on the trigger itself. This "pseudo trigger" is placed on either side of the trigger and in close proximity to the actual trigger, and slightly wider in order accommodate the width of the trigger and the finger guard.

Another preferred embodiment may have the "pseudo trigger" encapsulating the actual trigger within the housing of the TSU, whereby the TSU front surface in front of the trigger becomes the surface which is pressed by the user as the trigger, and a pressure gage or microswitch incorporated within the TSU senses the triggering action.

Figure 4A:
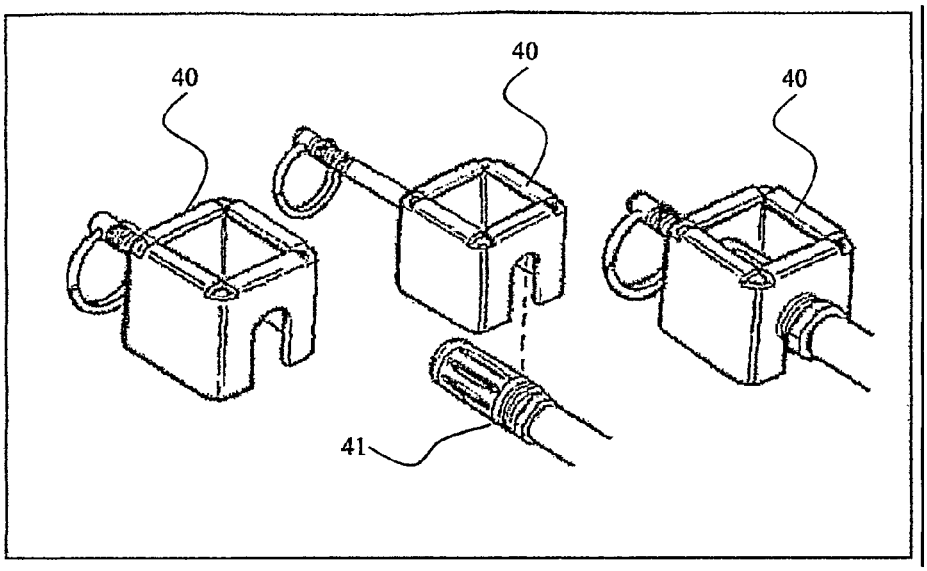
FIG. 4A is a schematic view of a prior art Blank Firing Attachment (BFA), which is used when firing blanks in automatic weapons.

Referring low more particularly to FIG. 4A, which illustrates a prior art Blank Firing Attachment (BFA), which is used when firing blanks in automatic weapons such as an M-16 assault rifle. The BFA is attached to the muzzle of the rifle 41, and is designed to keep sufficient gas in the barrel of the weapon to allow semiautomatic, automatic or burst firing with blank ammunition.

Figure 4B:
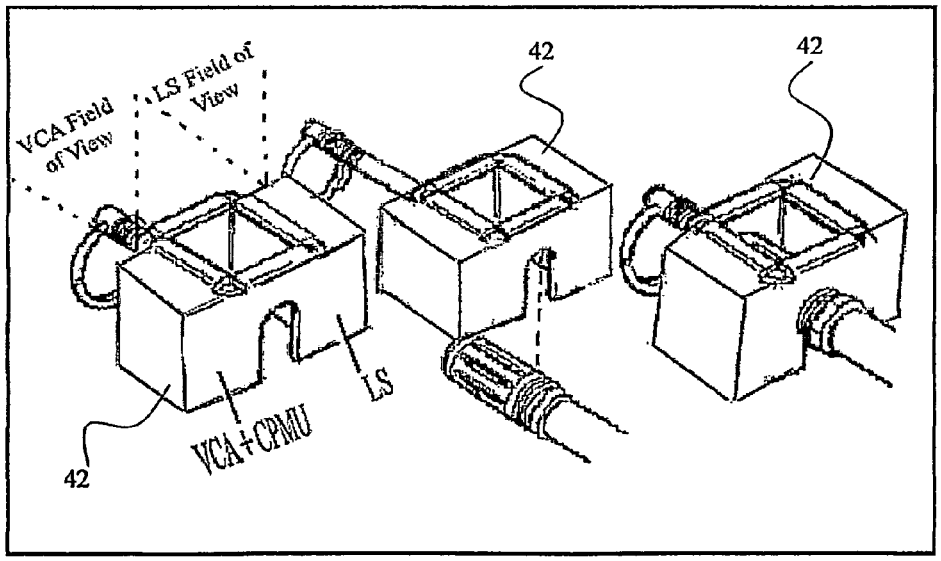
FIG. 4B is a schematic view of an Imaging Blank Firing Attachment (IBFA), constructed and operative according to a preferred embodiment of the present invention.

Reference is now made to FIG. 4B, which is a schematic illustration of Imaging BFA (IBFA) 42, constructed and operative according to another preferred embodiment of the present invention, wherein the VCU and preferably also the CPMU are integrated into the housing of the IBFA 42. A light source can also be optionally incorporated. The Imaging BFA (IBFA) may be used for dry as well as blank training. The advantages of the IBFA is that is well attached and aligned to the muzzle, bore and the flash-reducer, hence maintaining boresight with the weapon even during blank firing with considerable recoil. The IBFA may be constructed to retain the original dimensions of the BFA, this requiring a high level of electronic and optical integration. Alternatively and preferably, as depicted in FIG. 4B, the IBFA may comprise an enlarged casing to enable more simplified integration of the optical and electronic components.

Figure 5:
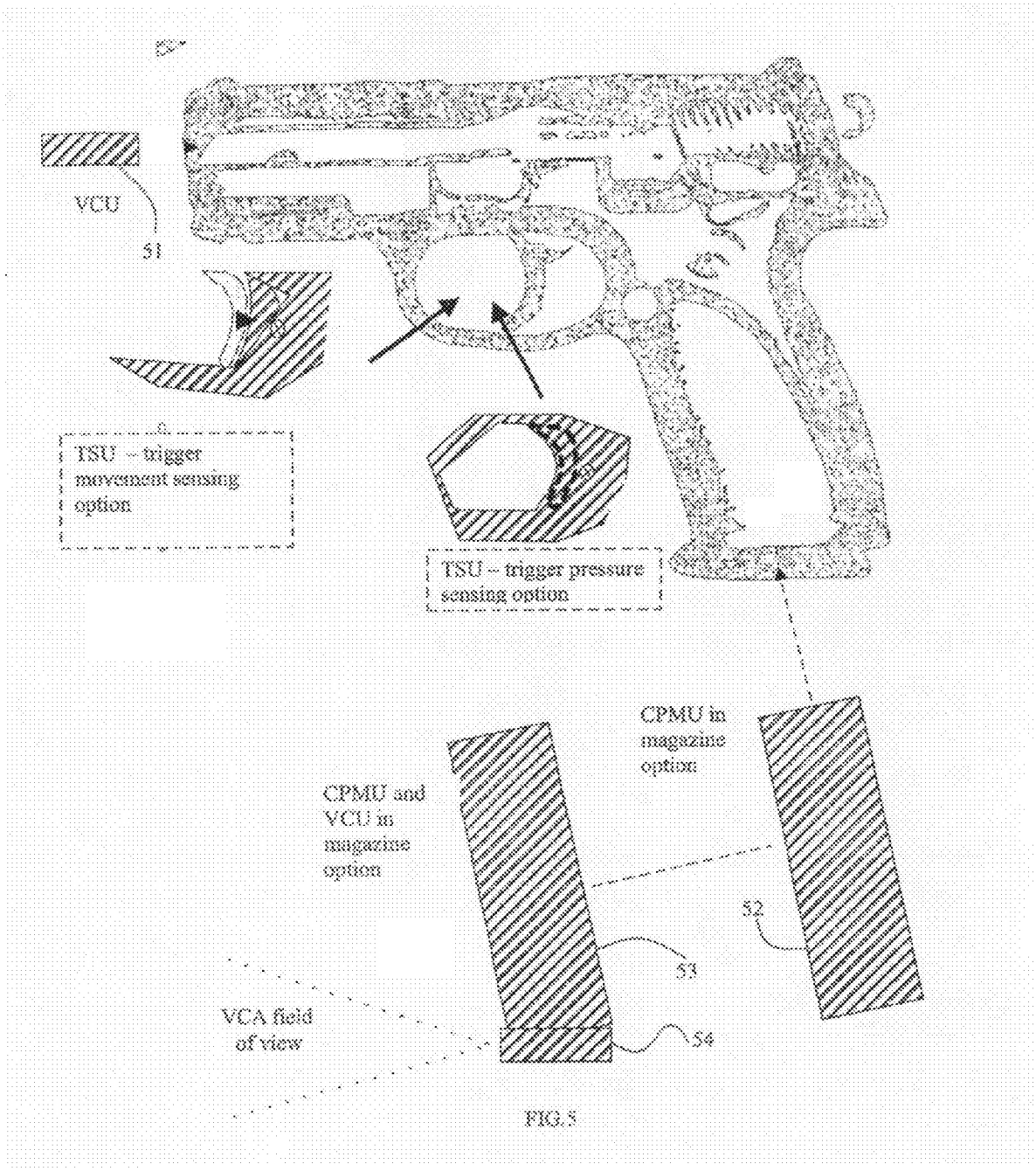
FIG. 5 is a side view of one embodiment of a representative automatic hand gun, illustrating the three main components of the training system integrated into the weapon by utilizing the teachings of the present invention.

FIG. 5 is another preferred embodiment of the invention for automatic handgun applications. One option depicted in FIG. 5 incorporates the VCU within the front barrel 51, and the CPMU in a magazine 52 of standard dimensions, and whereby the TSU may be implemented in two different options. A second option as depicted in FIG. 5 provides for the inclusion of the VCU and the CPMU in an extended magazine 53, of comparable dimensions to magazines with extra rounds. The optic of the VCA is placed at the far end 54 of the extended magazine for observing the scene.

Figure 6:
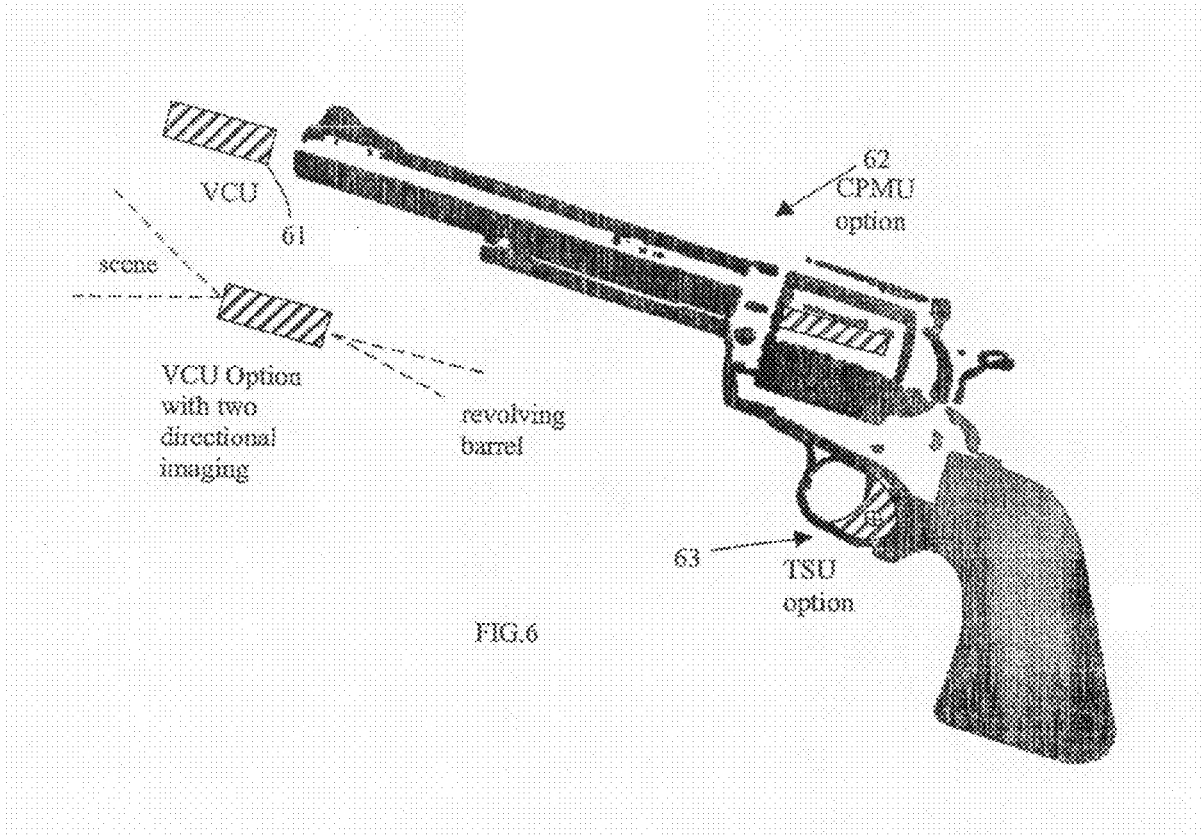
FIG. 6 is a side view of one embodiment of a representative revolver, illustrating the three main components of the training system integrated into the weapon by utilizing the teachings of the present invention.

FIG. 6 is another preferred embodiment of the invention for revolver handgun applications. In this preferred embodiment, the VCU 61 is placed in the front bore, the CPMU 62 is preferably placed in a bullet casing in the revolver drum or elsewhere. One option depicted in FIG. 6 incorporates the VCU within the front barrel, and the TSU 63 as depicted. Another preferred configuration includes a VCU in the front bore but also including, to replace the function of the TSU. a backward observing optic which senses the revolving barrel using image processing The above described system enables a trainee to utilize his weapon as a training weapon, whereby a VCA, CPMU and TSU are attached to the weapon in various configurations and options. The system enables collection of video data recordings of aiming and slewing synchronized with the triggering actions of the trainee. The recorded video data is then assessed and scored.

Figure 7:
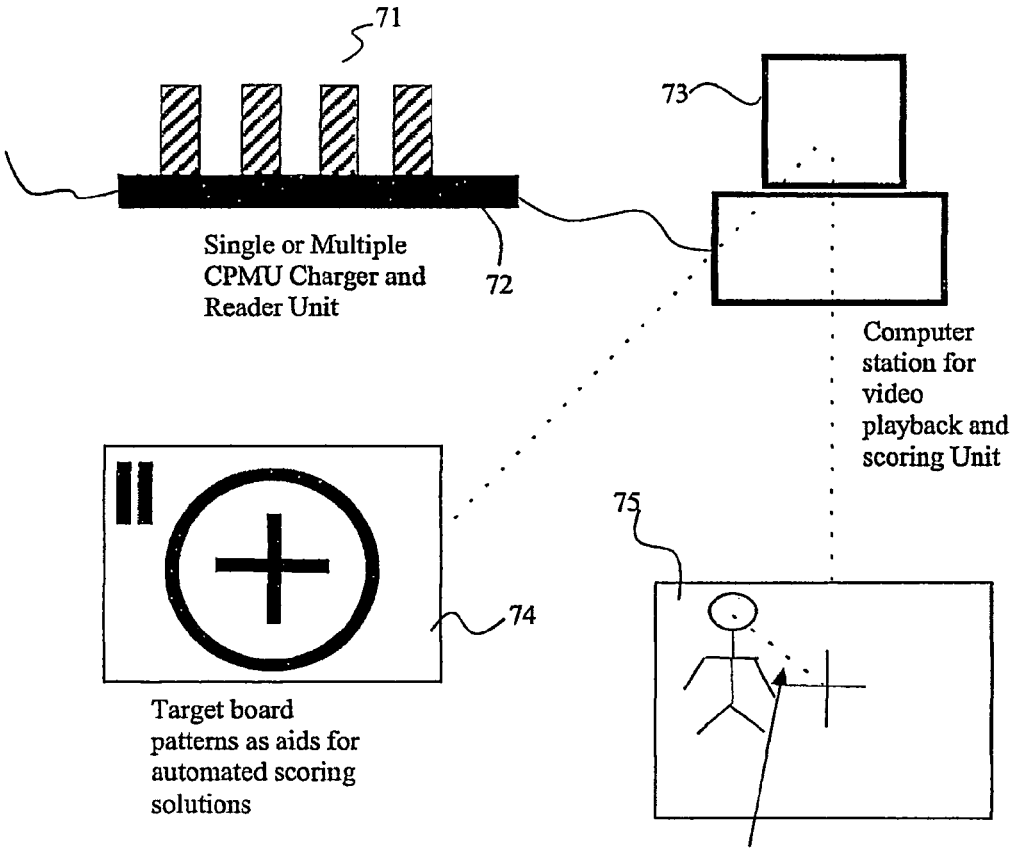
FIG. 7 is a view of multiple training kit units connected to a charging unit and a computer for scoring and charging constructed in accordance with the teachings of the present invention.

FIG. 7 is a view of multiple systems 71 connected to a charging unit 72 which charges the system battery and a computer for scoring 73, constructed and operative in accordance with a further preferred embodiment of the present invention. In a training exercise, the trainee first charges his system and synchronizes its timer, and returns to the scoring system after the exercise ends. The data is downloaded through the interface unit to the computer, including timing information on the triggering actions. The computer software plays back the recorded video data, and displays it on screen for the instructor's assessment. The trigger timing data is utilized to display the respective imagery depicting the aiming of the trainee in the proximity of the triggering timing, and can thus include a complete display of the trainee's aiming performance as he slews his weapon close to and up to the instant of firing. The system thus enables assessment of the trainee's performance under true dynamic simulated combat conditions.

Several levels of offline scoring approaches may be taken, depending on system complexity and requirements, and may be categorized as follows:

1. Observation only in video playback mode, whereby the triggering timing data is used to focus on time segments of interest.
2. All of the above, and including observation with software which provides various playback features, including still frame, slow motion, back-forwards play, electronic zooming, contrast improvements etc.
3. All of the above, and including manual (or automated) designation of desired aim point, and comparative error analysis with respect to actual aiming point. The range to the target may be assessed in cases where a designated fiducial, such as a cross of known dimensions, is used on, for example, a target board 74. The instructor may use the computer mouse to designate the desired aim point in the first frame 75, and then an image matching algorithm may be applied to measure the error in pixels between the actual aim point by the trainee at the instant of firing, and the designated aim point as transformed from the first frame to the frame displayed at the instant of firing. Furthermore, the instructor may designate two other points in the image between which the distance is known, for example, a cross of known dimensions, or a face of a human, or shoulders width, and then the analysis can be provided in terms of actual error in displacement (e.g. centimeters).

The next level of scoring may be done in real time, whereby all data is transmitted to a scoring center for real time analysis.

The system supports various training modes, including single trainee, one on one, one on many, and many on many. The three modes are described below:

1. Single trainee: The trainee maneuvers through an area of various targets and threats and is required to aim and fire at them in a timely and accurate manner. The aiming process is scored.
2. One on One: The trainee maneuvers through an area where another trainee or instructor is positioned and/or maneuvering. The objective of the training exercise is to successfully aim and fire at the targets in the area as well as on the instructor/adversary. The instructor/adversary also uses the training system, so that two videos are recorded concurrently after being synchronized in time. In the scoring process, the two videos are played back concurrently, and the aiming performance is assessed for both. Since the videos are synchronized in time, their respective triggering times can be compared for aiming performance and number of kills.
3. One on Many: The trainee maneuvers through an area where other trainees or instructors (adversaries) are positioned and/or maneuvering. The objective of the training exercise is to successfully aim and fire at the placed targets and the maneuvering adversaries in the area. The adversaries also use the training system, so that multiple videos are recorded concurrently after being synchronized in time. In the scoring process, the videos are played back concurrently, and the aiming performance is assessed for all. Since the videos are synchronized in time, their respective triggering times can be compared for aiming performance and number of kills.
4. Many on Many: Multiple trainees maneuver through an area where other trainees or instructors (adversaries) are positioned and/or maneuvering. The objective of the training exercise is for the trainees to successfully aim and fire at the placed targets and the maneuvering adversaries in the area. The adversaries also use the training system, so that multiple videos are recorded concurrently after being synchronized in time. In the scoring process, the videos are played back concurrently, and the aiming performance is assessed for all. Since the videos are synchronized in time, their respective triggering times can be compared for aiming performance and number of kills. In this mode, it may be helpful to enable trainee and adversary group identification by adding some visible identification aids which are easily observable in the videos.

The above described system can also be installed in a dedicated training weapon whereby the VCA, CPMU and TSA are appropriately designed and integrated into the gun. This will reduce the complexity of the installation on the personal weapon of the trainee, at the cost of requiring dedicated training weapons at sufficient numbers to support the various frameworks of the training units.

The above described system and various configuration options may be applicable also to training application of machine guns, air defense guns, tank guns etc, whereby the idea is to incorporate a VCU, CPMU and TSU for collecting aiming data and assess the performance in various exercises.

Elements of the system may also be utilized as recording devices for actual combat operations. In the case of police operations, for example, a recording action may be done automatically and stored for later examination, as in the example of shooting or arresting whereby there may be a citizen complaint or any sort of post-event investigation. Moreover, the system may also provide a real time transmission of images from a scene of a crime where a policeman is involved to a central command station.

Figure 8:
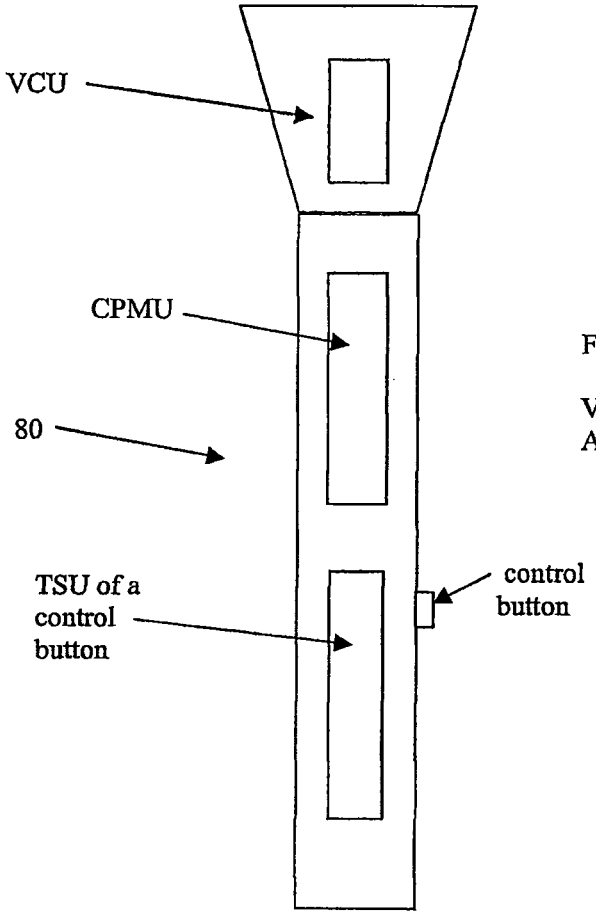
FIG. 8 is a view of a flashlight application for training soldiers, special operations policemen and guards and for security applications in accordance with the teachings of the present invention.

An additional application of the system as depicted in FIG. 8 may be to be utilized as a video recording device encased in a flashlight 80 which will provide both day and night time recording and possible transmission to a central command station. Such flash light application may incorporate the flashlight light source as the LS, and the VCA 61 is incorporated to collect the imagery illuminated by the LS. The CPMU 62 records the data, and a control button on the flashlight may be utilized instead of the triggering device, when the device is used for training. The video flashlight may be used during training or for support of actual patrol of a guard on duty, whereby the video is recorded and/or transmitted in real time to a central command station for further monitoring and support. Police officers often use flashlights for night operations, for identifying suspects, reading their ID cards etc. The video flashlight may be utilized in day and night time, whereby the imagery captured are stored for later assessment and record keeping of events.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention.

I claim:

1. A system for training use of a small-arms weapon having a barrel, said system comprising:

an insert comprising a video camera, said insert having dimensions enabling it to be inserted into the barrel of said weapon; and an electronic processing unit receiving an output of said video camera, wherein said insert is such that said training use of said weapon is not affected by use of said system, and said insert also comprises a rear view imager.

2. The system according to claim 1, wherein said electronic processing unit is also located within said insert.

3. The system according to claim 1, wherein said electronic processing unit is located remotely from said insert.

4. The system according to claim 1 and also comprising a battery.

5. The system according to claim 1 and wherein said electronic processing unit comprises a memory for storing data originating from said video camera.

6. The system according to claim 1 and wherein said electronic processing unit transmits data originating from said video camera to a remote location.

7. The system according to claim 1 and wherein the external form of said weapon is unaffected by use of said system.

8. The system according to claim 1 and wherein the use of said weapon is unaffected by use of said system.

9. The system according to claim 1 and wherein use of said system does not mandate any alteration to said weapon.

10. The system according to claim 1, wherein said insert has essentially the same external outline as a bullet for use in said weapon.

11. The system according to claim 1, wherein said video camera is boresighted with said weapon.

12. The system according to claim 1, wherein said insert is inserted into the breech of said weapon.

13. The system according to claim 1, wherein said insert is inserted into the front barrel of said weapon.

14. The system according to claim 1, wherein said weapon also comprises a trigger, and wherein said system also comprises a trigger sensing unit which provides a signal when said trigger of said weapon is pressed.

15. The system according to claim 14 and wherein said trigger sensing unit does not affect the user's tactile sensation of said trigger.

16. A system according to claim 1, configured for assessing the accuracy of a user's aimpoint at a target, said system further comprising:

a weapon having a trigger, said video camera being boresighted with said weapon, and said electronic processing unit receiving the output of said video camera comprising an image processing unit generating data for displaying an image depicting the aimpoint of said weapon, and said rear imager being operable as a trigger sensing unit a designating system for designating an intended target aimpoint on a video frame of said image depicting said target; and an image matching algorithm for transforming said intended target aimpoint to at least one frame depicting said target at a later time.

17. A system according to claim 16, and wherein said at least one frame depicting said target at a later time is a frame taken when said trigger is pressed.

18. A system according to claim 16, and wherein said at least one frame depicting said target at a later time is a series of frames taken up to the point when said trigger is pressed.

19. A system according to claim 16, comprising a trigger sensing unit attached to said weapon, for detecting when said trigger is pressed.

20. A training round of ammunition for a weapon, said round comprising a video camera for generating a forward looking boresighted image when said round is inserted into the breech of said weapon, and wherein said round has an external form essentially identical to that of a conventional round for said weapon, and said round also comprises a rear view imager.

21. A training round according to claim 20, and wherein said round also comprises at least one of an electronic processing unit receiving an output of said video camera and a battery.

22. A training round according to claim 20, and wherein said round also comprises a hammer hit detector.

* * * * *